US011541324B2

(12) United States Patent
Chang

(10) Patent No.: US 11,541,324 B2
(45) Date of Patent: Jan. 3, 2023

(54) SMOKE GENERATOR WITH PRE-PRESSURIZED RAPID OIL SUPPLY

(71) Applicant: NOVACORP INC., Guangzhou (CN)

(72) Inventor: Ming-Cheng Chang, Tainan (TW)

(73) Assignee: NOVACORP INC., Guangzhou (CN)

( * ) Notice: Subject to any disclaimer, the term of this patent is extended or adjusted under 35 U.S.C. 154(b) by 685 days.

(21) Appl. No.: 16/699,246

(22) Filed: Nov. 29, 2019

(65) Prior Publication Data

US 2020/0230515 A1 Jul. 23, 2020

(30) Foreign Application Priority Data

Jan. 17, 2019 (TW) ..... 108101740

(51) Int. Cl.
*A63J 5/02* (2006.01)

(52) U.S. Cl.
CPC ..... *A63J 5/025* (2013.01)

(58) Field of Classification Search
CPC .... A63J 5/02; A63J 5/025; A63J 5/023; A63J 21/00; A63J 25/00
USPC ..... 472/65, 75–81; 40/428
See application file for complete search history.

(56) References Cited

U.S. PATENT DOCUMENTS 4,836,452 A * 6/1989 Fox ..... A63J 5/025 239/338
2015/0014430 A1* 1/2015 Scully ..... B05B 7/1686 239/8
2017/0259184 A1* 9/2017 Xu ..... B05B 15/58
2017/0319979 A1* 11/2017 Liao ..... A63J 5/025
2017/0363283 A1* 12/2017 Chang ..... A63J 5/025
2018/0136075 A1* 5/2018 Lerman ..... G01M 3/025

* cited by examiner

*Primary Examiner* — Kien T Nguyen
(74) *Attorney, Agent, or Firm* — Alan D. Kamrath; Karin L. Williams; Mayer & Williams PC

(57) ABSTRACT

A smoke generator includes an oil tank receiving an oil to be pumped by an oil pump to a vaporization tube where the oil vaporized into smoke after heating by a heater. A pre-pressurization oil supply device is disposed between the vaporization tube and the oil pump. When the pre-pressurization oil supply device is in a non-supply state not intercommunicating with the vaporization tube, the pre-pressurization oil supply device maintains its internal pressure, and the oil in the pre-pressurization oil supply device is not delivered to the vaporization tube. When the pre-pressurization oil supply device is in an oil supply state, the pre-pressurization oil supply device intercommunicates with the vaporization tube, and the oil in the pre-pressurization oil supply device is rapidly delivered to the vaporization tube.

8 Claims, 11 Drawing Sheets

SMOKE GENERATOR WITH PRE-PRESSURIZED RAPID OIL SUPPLY

BACKGROUND OF THE INVENTION

The present invention relates to a smoke generator and, more particularly, to a smoke generator for rapidly generating smoke through pre-pressurizing an oil.

To provide a better visual effect during stage performance, a smoke generator is disposed on a stage to provide a smoke effect cooperating with the music and light effects. A type of smoke generator heats and vaporizes an oil into smoke, which involves delivery of the oil from an oil tank to a vaporization tube by using an oil pump. Then, a heater of the smoke generator heats the vaporization tube to vaporize the oil. Since it takes time for the oil pump to deliver the oil to the vaporization tube, the air in a section of the vaporization tube having not received the oil yet will expand and have a higher internal pressure after heating. Thus, it takes about 2-4 seconds to reach the maximum pressure for ejecting the smoke after the oil pump delivers the oil to the vaporization tube. As a result, the smoke ejecting procedure is not smooth, and the smoke output rate is not uniform.

BRIEF SUMMARY OF THE INVENTION

To solve the above disadvantages, the present invention provides a smoke generator comprising:

an oil tank configured to receive an oil;

an oil pump communicating with the oil tank and configured to pump the oil out of the oil tank;

a vaporization tube intercommunicating with the oil pump and configured to receive the oil from the oil pump;

a pre-pressurization oil supply device connected to and disposed between the vaporization tube and the oil pump, wherein when the oil pump operates, a portion of the oil moves into the pre-pressurization oil supply device and causes an increase in an internal pressure in the pre-pressurization oil supply device, and wherein the pre-pressurization oil supply device is switchable between an oil supply state for supplying the oil and a non-supply state not supplying the oil;

a heater disposed adjacent to the vaporization tube and configured to vaporize the oil in the vaporization tube into smoke, wherein when the pre-pressurization oil supply device is in the non-supply state, the pre-pressurization oil supply device does not intercommunicate with the vaporization tube, the pre-pressurization oil supply device maintains its internal pressure, and the oil in the pre-pressurization oil supply device is not delivered to the vaporization tube, and wherein when the pre-pressurization oil supply device is in the oil supply state, the pre-pressurization oil supply device intercommunicates with the vaporization tube, and the oil in the pre-pressurization oil supply device is rapidly delivered to the vaporization tube.

In an example, the smoke generator further comprises an oil supply control valve disposed between and intercommunicating with the pre-pressurization oil supply device and the vaporization tube. The oil supply control valve is configured to switch between an intercommunication state in which the pre-pressurization oil supply device supplies the oil and a non-intercommunication state in which the pre-pressurization oil supply device does not supply the oil.

In an example, the smoke generator further comprises:

a first oil supply tube disposed between and intercommunicating with the oil tank and the oil pump;

a three-way oil supply member including an input end, an output end, and a connection end coupled to the pre-pressurization oil supply device;

a second oil supply tube disposed between and intercommunicating with the oil pump and the input end of the three-way oil supply member; and a third oil supply tube disposed between and intercommunicating with the oil supply control valve and the output end of the three-way oil supply member, wherein when the oil pump operates, the oil passes through the second oil supply tube, the three-way oil supply member, the third oil supply tube, and the oil supply control valve and enters the vaporization tube, and wherein when the pre-pressurization oil supply device is in the oil supply state, the oil passes through the three-way oil supply member, the third oil supply tube, and the oil supply control valve and enters the vaporization tube.

In an example, the smoke generator further comprises:

a first return oil control valve switchable between an intercommunication state and a non-intercommunication state, wherein the first return oil control valve includes a guiding end and an oil return end;

a first three-way fitting intercommunicating with the vaporization tube;

a first return oil tube connected between the guiding end of the first return oil control valve and the first three-way fitting;

a second return oil tube intercommunicating with and disposed between the oil return end of the first return oil control valve and the oil tank, wherein when the oil supply control valve is in the intercommunication state, the first return oil control valve is set to the non-intercommunication state, and the vaporization tube prevents the oil to flow in a reverse direction, and wherein when the oil supply control valve is in the non-intercommunication state, the first return oil control valve is set to remain in the intercommunication state for a maintaining period of 1-2 seconds, unvaporized oil in the vaporization tube is moved by the internal pressure in the vaporization tube to flow back into the oil tank, and the first return oil control valve returns to the non-intercommunication state after the maintaining period.

In an example, the smoke generator further comprises:

a three-way connector including an oil supply passageway, a first return oil passageway, and a second return oil passageway, wherein the first return oil passageway and the second return oil passageway are spaced from the oil supply passageway, wherein the first oil supply tube is connected to the oil supply passageway, wherein the second return oil tube is connected between the first return oil passageway and the oil return end of the first return oil control valve;

a third oil supply tube disposed between and intercommunicating with the output end of the three-way oil supply member and an inlet of the oil supply control valve;

a second three-way fitting coupled to the third oil supply tube;

a second return oil control valve including a first end and a second end, wherein the first return oil tube intercommunicates with and is disposed between the guiding end of the first return oil control valve and the first three-way fitting, wherein the second return oil control valve is switchable between an intercommunication state and a non-intercommunication state;

a third return oil tube disposed between and intercommunicating with the oil tank and the first return oil passageway;

a fourth return oil tube disposed between and intercommunicating with the first end of the second return oil control valve and the second three-way fitting; and a fifth return oil tube disposed between and intercommunicating with the second end of the second return oil control valve and the second return oil passageway of the three-way connector, wherein when the second return oil control valve is in the non-intercommunication state, the oil pumped by the oil pump flows to the second oil supply tube, and wherein when the second return oil control valve is in the intercommunication state, the oil pumped by the oil pump flows through the fourth return oil tube, the second three-way fitting, the second return oil tube, and the third return oil tube and flows into the oil tank.

In an example, the pre-pressurization oil supply device further includes:

a cylinder including a storage chamber and intercommunicating with the oil pump, wherein when the oil pump operates, the portion of the oil enters the storage chamber;

a sleeve securely disposed to an end of the cylinder;

a movable member movably mounted to the sleeve, wherein the movable member includes a squeezing end received in the storage chamber of the cylinder; and an elastic biasing member received in the sleeve and biasing the cylinder towards the movable member, wherein when the oil pump moves the storage chamber of the cylinder, the movable member moves towards the sleeve to an oil storage position and compresses the elastic biasing member, and wherein when the pre-pressurization oil supply device is in the oil supply state, the elastic biasing member biases the movable member towards the cylinder to an oil supply position, and the squeezing end moves the oil in the storage chamber of the cylinder into the vaporization tube.

In an example, the movable member further includes:

a first portion including the squeezing end and an assembling end spaced from the squeezing end, wherein the first portion further includes a seal disposed on the squeezing end, wherein the seal is received in the storage chamber of the cylinder and separates the storage chamber into two sections;

a second portion securely disposed on the assembling end of the first portion, wherein the second portion includes an actuating end and is received in a space of the sleeve, and wherein the elastic biasing member biases the second portion; and a sensor mounted on the sleeve;

wherein when the movable member is in the oil supply position, the actuating end is spaced from the sensor, and the oil pump is permitted to move the oil into the storage chamber, and wherein when the movable member is in the oil storage position, the actuating end actuates the sensor, the oil pump maintains operation when the oil supply control valve is in the intercommunication state or stops when the oil supply control valve is in the non-intercommunication state.

In an example, the smoke generator further comprises:

a three-way oil supply member including an input end, an output end, and a connection end coupled to the pre-pressurization oil supply device, wherein the cylinder further includes a first hole intercommunicating with the storage chamber and a second hole intercommunicating with the storage chamber and spaced from the first hole in a longitudinal direction, wherein the seal is located between the first hole and the second hole in the longitudinal direction, and wherein the connection end of the three-way oil supply member is coupled to and intercommunicates with the first hole;

a return oil fitting including a coupling end and an oil return end, wherein the coupling end of the return oil fitting is coupled to and intercommunicates with the second hole of the cylinder;

a second oil supply tube disposed between and intercommunicating with the oil pump and the input end of the three-way oil supply member;

a third oil supply tube disposed between and intercommunicating with the oil supply control valve and the output end of the three-way oil supply member, wherein when the oil pump operates, the oil passes through the second oil supply tube, the three-way oil supply member, the third oil supply tube, and the oil supply control valve and enters the vaporization tube, and wherein when the pre-pressurization oil supply device is in the oil supply state, the oil passes through the three-way oil supply member, the third oil supply tube, and the oil supply control valve and enters the vaporization tube; and a sixth return oil tube disposed between and intercommunicating with the first return oil passageway of the three-way connector and the oil return end of the oil supply control valve, wherein oil leaked through the seal flows through the second hole, the oil return end of the oil supply control valve, the sixth return oil tube, the first return oil passageway of the three-way connector, and the third return oil tube and flows back into the oil tank.

The present invention will become clearer in light of the following detailed description of illustrative embodiments of this invention described in connection with the drawings.

Figure 1:
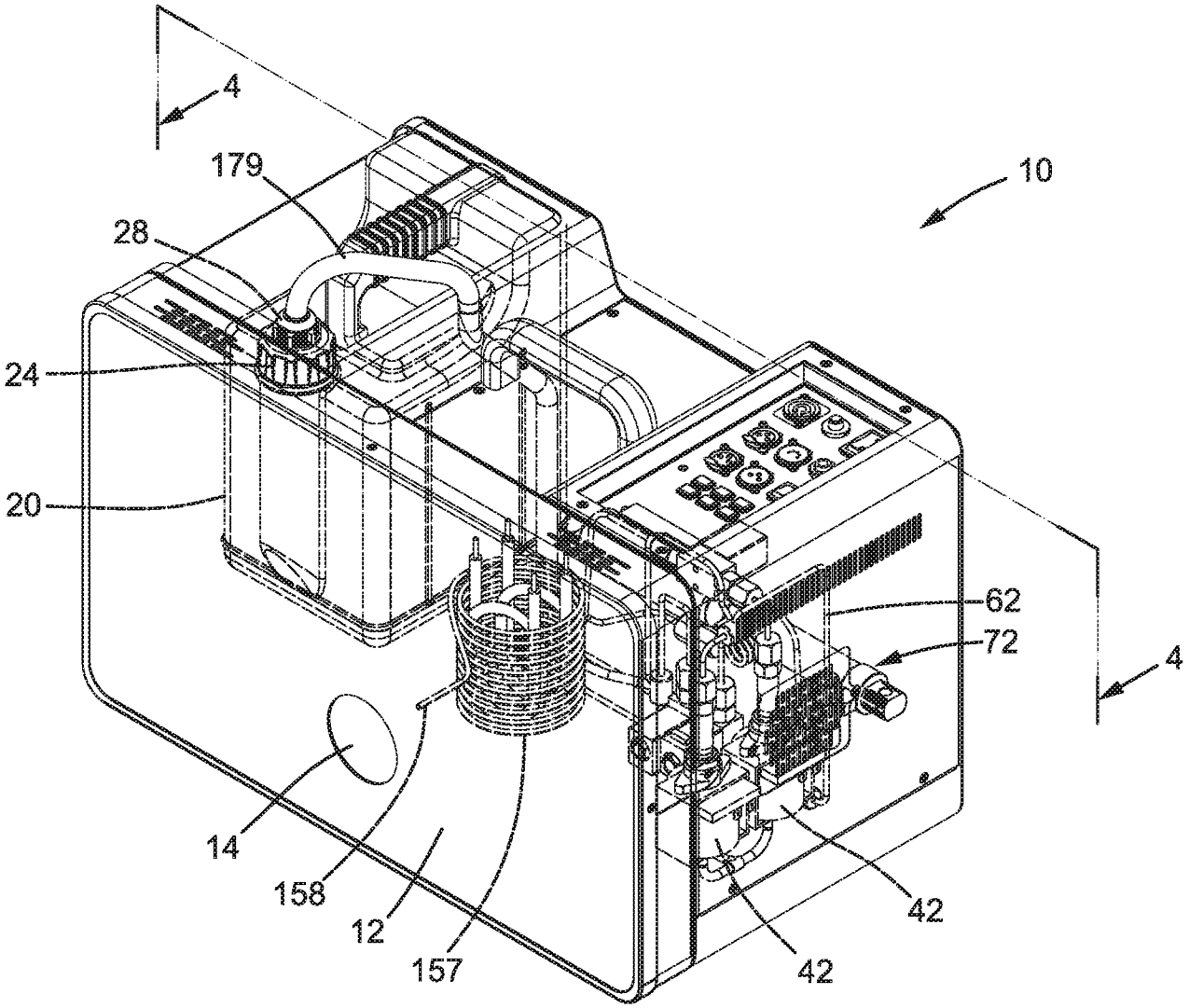
FIG. 1 is a perspective view of a smoke generator of an embodiment according to the present invention.
Figure 2:
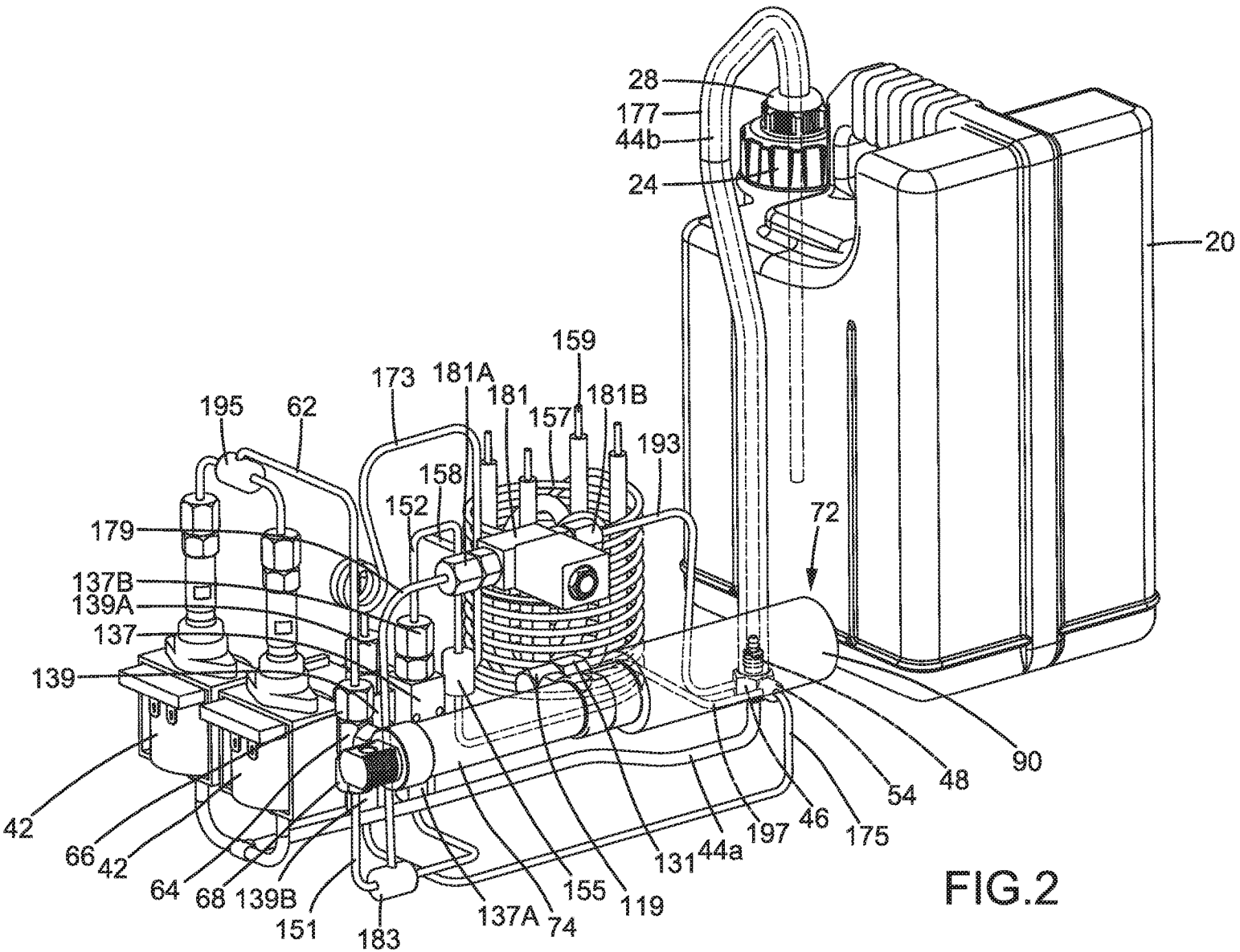
FIG. 2 is a perspective view of an oil delivery mechanism of a smoke generator according to the present invention.
Figure 3:
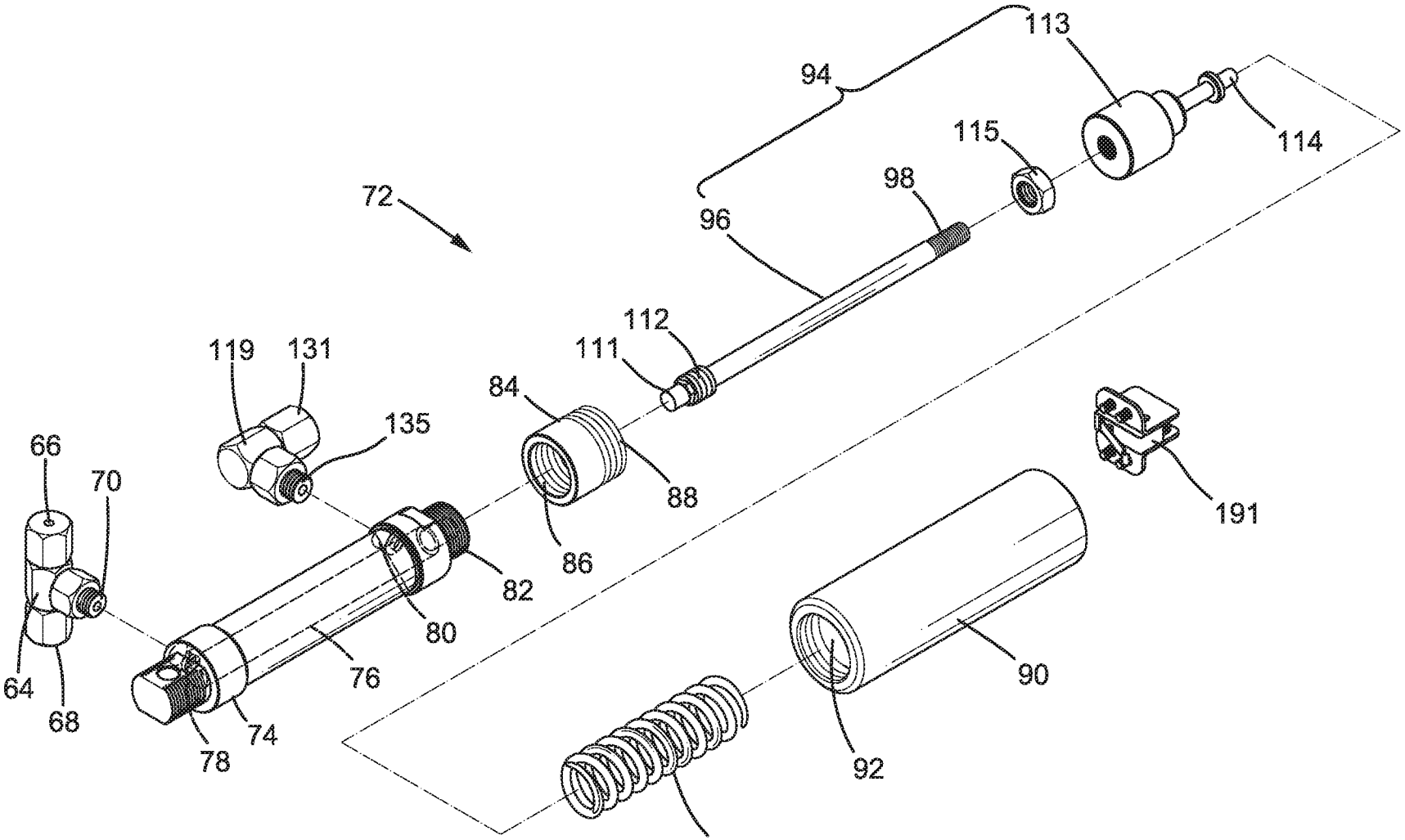
FIG. 3 is a pre-pressurized oil supply device of the smoke generator according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth". "fifth", "sixth", "top", "bottom", "inner". "outer", "side", "end", "portion", "section". "part", "longitudinal", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 7:
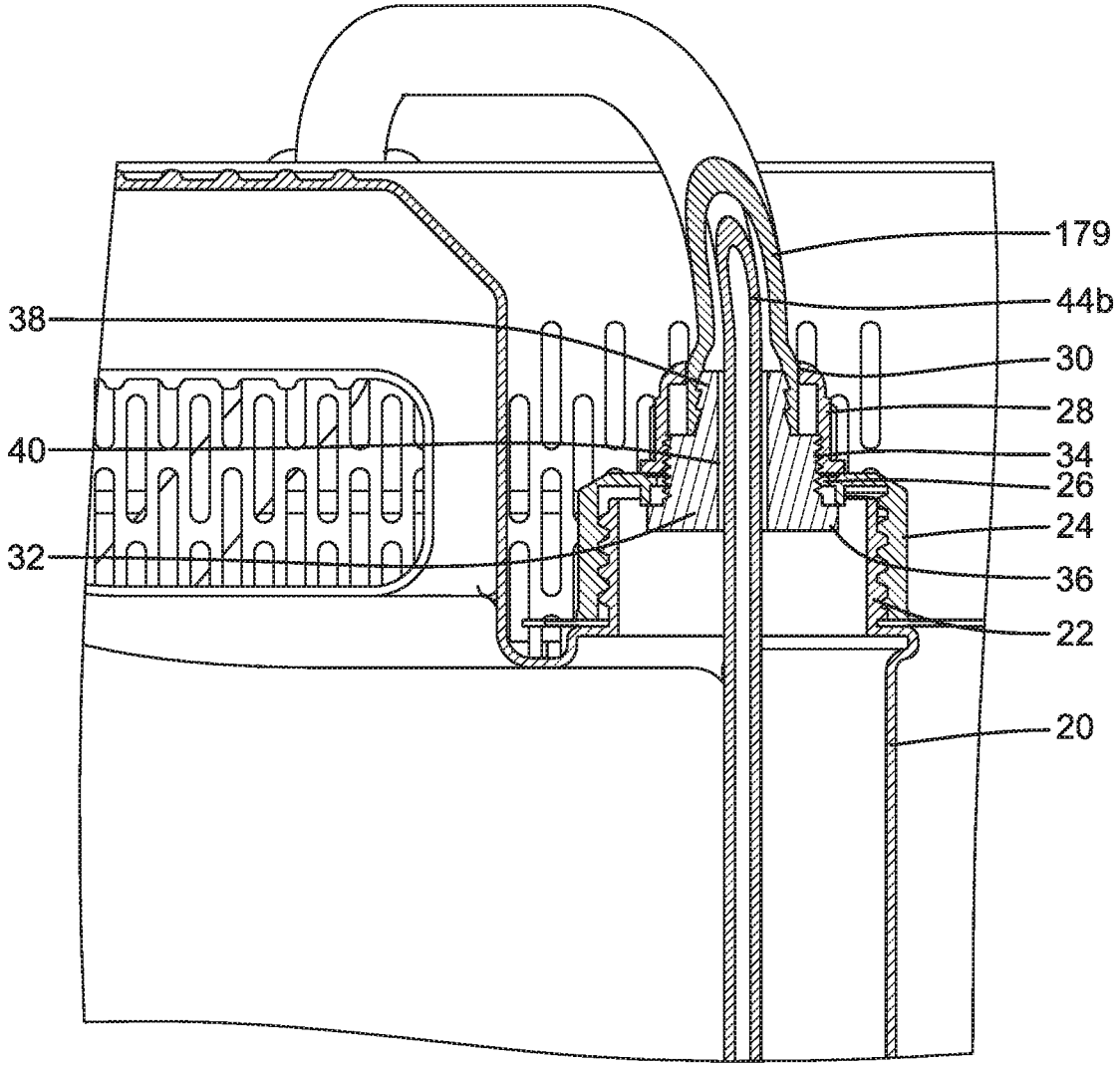
FIG. 7 is a cross sectional view taken along section line 7-7 of FIG. 4.

With reference to FIGS. 1-5, a smoke generator 10 of an embodiment according to the present invention is used on a stage and heats and vaporizes an oil into smoke which is ejected to provide a stage performance effect. The smoke generator 10 includes a casing 12 having a smoke outlet 14. An oil tank 20 is mounted in the casing 12 and includes a casing fitting 22 intercommunicating with an interior of the casing 12. A first cap 24 and a second cap 28 are threadedly coupled to the casing fitting 22. A connecting member 32 (FIG. 7) is disposed between the first cap 24 and the second cap 28. The first cap 24 includes a through-hole 26. The second cap 28 includes a through-hole 30. The connecting member 32 includes an outer periphery having a threaded portion 34 and a flange 36 disposed on a bottom portion of the threaded portion 34 and having an outer diameter larger than an inner diameter of the through-hole 26 of the first cap 24. The connecting member 32 further includes a return oil fitting 38 disposed on a top portion of the threaded portion 34 and a channel 40 extending from an end face of the return oil fitting 38 to an end face of the flange 36.

The first cap 24 is threadedly coupled to the casing fitting 22. The connecting member 32 is mounted in the through-hole 26 of the first cap 24, and the flange 36 abuts an inner surface of the first cap 24. The threaded portion 34 is located outside of the first cap 24. The second cap 28 is threadedly coupled to the threaded portion 34 of the connecting member 32 and abuts an outer periphery of the first cap 24. Thus, the connecting member 32 is sandwiched between the first cap 24 and the second cap 28. A first oil supply tube 44 extends through the channel 40 of the connecting member 32 and has an outer diameter smaller than an inner diameter of the channel 40. Thus, a gap exists between the first oil supply tube 44 and the inner periphery of the channel 40. Furthermore, an end of the first oil supply tube 44 is adjacent to a bottom of the oil tank 20.

Figure 6:
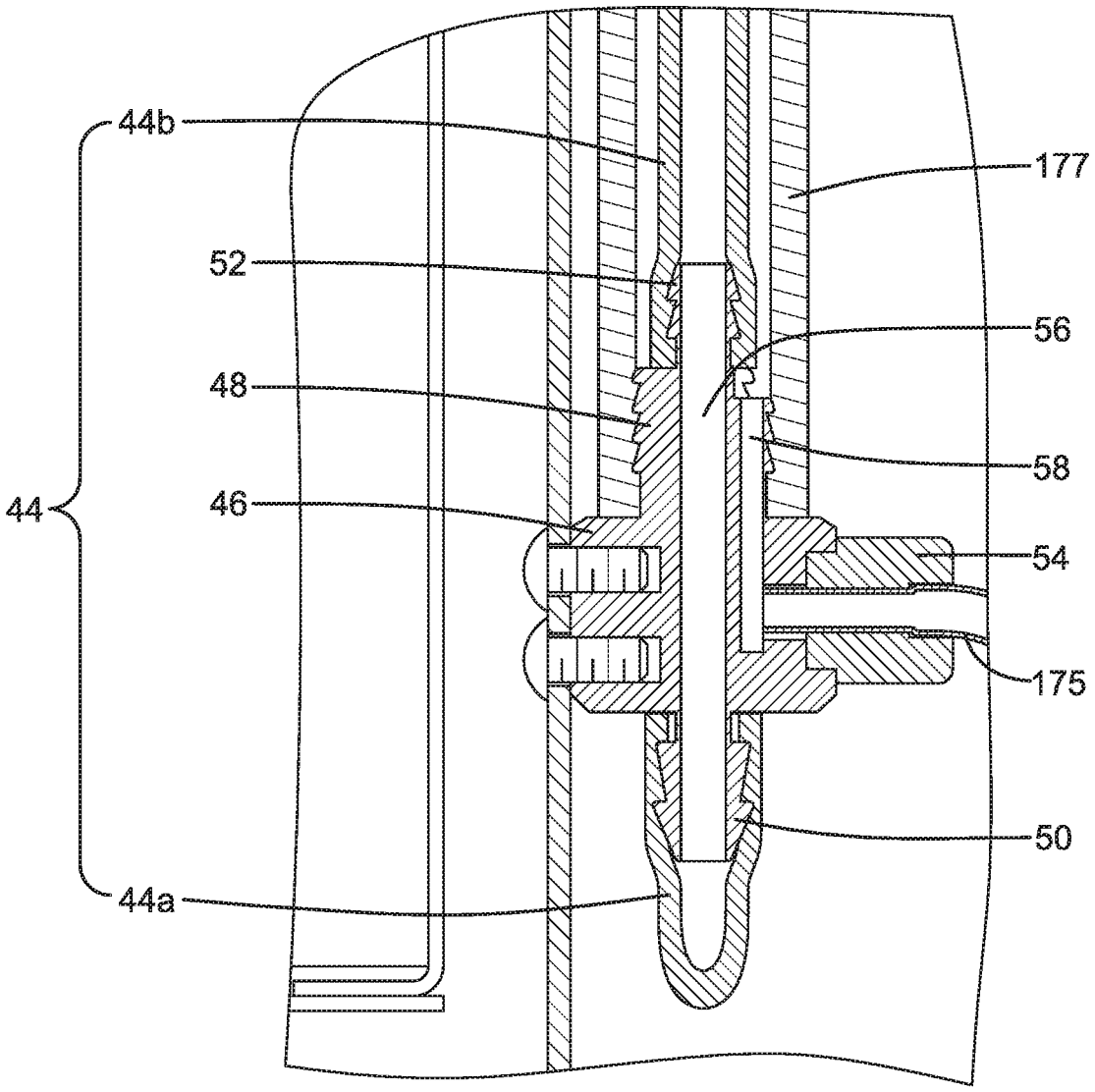
FIG. 6 is a cross sectional view taken along section line 6-6 of FIG. 5.
Figure 6A:
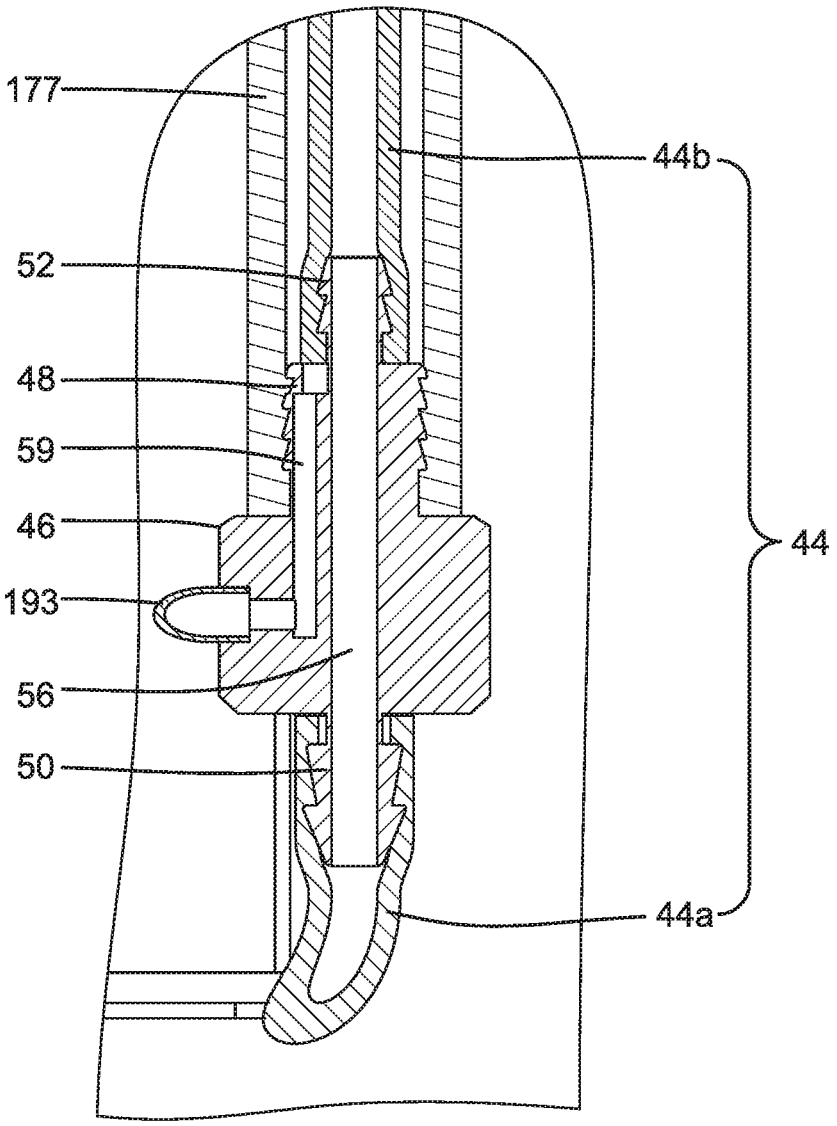
FIG. 6A is a cross sectional view taken along section line 6A-6A of FIG. 5.

The first oil supply tube 44 intercommunicates with a three-way connector 46. In this embodiment, the first oil supply tube 44 includes a first section 44*a* and a second section 44*b* (see FIG. 4) connected to the first section 44*a* via the three-way connector 46. As shown in FIG. 6, the three-way connector 46 includes a first face with a first return oil fitting 48 and a second face with a first oil supply fitting 50. A second oil supply fitting 52 is disposed on an end face of the first return oil fitting 48. An oil supply passageway 56 extends between and intercommunicates with the first oil supply fitting 50 and the second oil supply fitting 52. The three-way connector 46 further includes a second return oil fitting 54 spaced from the first return oil fitting 48 and a first return oil passageway 58 extending between the first return oil fitting 48 and the second return oil fitting 54 (see FIG. 6). The three-way connector 46 further includes a second return oil passageway 59 (see FIG. 6A) extending from an outer periphery thereof to the end face of the first return oil fitting 48. The first return oil passageway 58 and the second return oil passageway 59 are spaced from and do not intercommunicate with the oil supply passageway 56. The first section 44*a* and the second section 44*b* of the first oil supply tube 44 are connected to the first oil supply fitting 50 and the second oil supply fitting 52, respectively. Thus, the first and second sections 44*a* and 44*b* of the first oil supply tube 44 intercommunicate with each other by the oil supply passageway 56. Furthermore, an end of the first section 44*a* of the first oil supply tube 44 distant from the oil tank 20 intercommunicate with two oil pumps 42 (see FIG. 2). When the two oil pumps 42 operate, the oil in the oil tank 20 is pumped out via the first oil supply tube 44.

The smoke generator 10 further includes a pre-pressurization oil supply device 72 mounted in the casing 12 and a second oil supply tube 62 disposed between and intercommunicating with the pre-pressurization oil supply device 72 and the two oil pumps 42. In this embodiment, an oil supply fitting 195 is disposed between and intercommunicates with output ends of the two oil pumps. An end of the second oil supply tube 62 is connected to the oil supply fitting 195. Thus, under operation of the two oil pumps 42, the oil is delivered through the oil supply fitting 195 to the second oil supply tube 62. The pre-pressurization oil supply device 72 includes a cylinder 74. The cylinder 74 includes an engaging end 82 (FIG. 5) and a storage chamber 76 extending from an end face of the engaging end 82. The cylinder 74 further includes first and second holes 78 and 80 extending from an outer periphery of the cylinder 74 to the storage chamber 76. The second hole 80 is near the engaging end 82 and is located between the first hole 78 and the engaging end 82.

The pre-pressurization oil supply device 72 further includes a sleeve 90 and a coupling member 84 for coupling the cylinder 74 and the sleeve 90. The connecting member 84 includes a first end 86 with an inner threading and a second end 88 with an outer threading. The sleeve 90 includes a space 92 having an outer end with an inner threading. The first end 86 of the connecting member 84 is in threadedly connected to the engaging end 82 of the cylinder 74. The second end 88 of the connecting member 84 is threadedly connected to the sleeve 90. Thus, the storage chamber 76 of the cylinder 74 intercommunicates with the space 92 of the sleeve 90. Furthermore, a sensor 191 is mounted on the cylinder 90 and includes an activating part extending into the space 92 (see FIG. 5).

The pre-pressurization oil supply device 72 further includes a movable member 94 movably mounted to the cylinder 74. The movable member 94 includes a first portion 96 and a second portion 113 coupled to the first portion 96. The first portion 96 includes an assembling end 98 with an outer threading and a squeezing end 111. The first portion 96 further includes a seal 112 mounted around an outer periphery of the first portion 96 and located between the assembling end 98 and the squeezing end 111. The second portion 113 includes an actuating end 114 extending from an end face thereof. The second portion 113 is threadedly coupled to the assembling end 98 of the first portion 96. Furthermore, a threaded positioning member 115 is provided to secure the second portion 113 to the assembling end 98. In this embodiment, the thread direction of the positioning member 115 is opposite to the thread direction of the second portion 113. Furthermore, the positioning member 115 is located between the squeezing end 111 of the first portion 96 and the second portion 113 (see FIGS. 4 and 5). Thus, when the positioning member 115 moves to a position abutting against a surface of the second portion 113, the second portion 113 cannot rotate and is, thus, secured relative to the first portion 96.

The squeezing end 111 of the movable member 94 and the seal 112 are movably received in the storage chamber 76 of the cylinder 74. The seal 112 is located between the first hole 78 and the second hole 80 (see FIGS. 4 and 5) to separate the space 92 of the sleeve 90 into two independent sections. The second portion 113 is movably received in the space 92 of the sleeve 90. An elastic biasing member 117 is received in the space 92 of the sleeve 90 and biases the second portion 113 of the movable member 94 towards the cylinder 74. The movable member 94 is movable between an oil storage position (see FIGS. 8 and 9) pressing against the elastic biasing member 117 and an oil supply position (see FIGS. 3 and 4). The room (for receiving oil) provided by the storage chamber 76 of the cylinder 74 while the movable member 94 is in the oil storage position is larger than the room (for receiving oil) provided by the storage chamber 76 of the cylinder 74 while the movable member 94 is in the oil supply position. Furthermore, when the movable member 94 is in the oil supply position, the actuating end 114 of the second portion 113 is spaced from the sensor 191. On the other hand, when the movable member 94 is in the oil storage position, the actuating end 114 of the second portion 113 actuates the sensor 191.

The smoke generator 10 further includes a three-way oil supply member 64 and a return oil fitting 119 both of which are coupled to the pre-pressurization oil supply device 72. The three-way oil supply member 64 includes an input end 66, an output end 68, and a connection end 70 intercommunicating with the input end 66 and the output end 68. The connection end 70 of the three-way oil supply member 64 is coupled to and intercommunicates with the first hole 78 of the cylinder 74. The return oil fitting 119 includes an oil return end 131 and a coupling end 135 intercommunicating with the oil return end 131. The coupling end 135 of the return oil fitting 119 is coupled to and intercommunicates with the second hole 80 of the cylinder 74. The other end of the second oil supply tube 62 is coupled to and intercommunicates with the input end 66 of the three-way oil supply member 64. When the two oil pumps 42 operate, the oil in the oil tank 20 is delivered to the storage chamber 76 of the pre-pressurization oil supply device 72 and pushes the movable member 94 to move from the oil supply position (see FIGS. 4 and 5) to the oil storage position (see FIGS. 8 and 9).

The smoke generator 10 further includes an oil supply control valve 137, a first return oil control valve 139, and a first three-way fitting 155, all of which are mounted in the casing 12. The oil supply control valve 137 includes an inlet 137A and an outlet 137B. A third oil supply tube 151 is disposed between the inlet 137A of the oil supply control valve 137 and the output end 68 of the three-way oil supply member 64. A second three-way fitting 183 (see FIG. 2) is disposed at an intermediate portion of the third oil supply tube 151. Namely, the third oil supply tube 151 is separated into two sections. An end of one of the two sections of the third oil supply tube 151 is connected to a first end of the second three-way fitting 183. An end of another of the two sections of the third oil supply tube 151 is connected to a second end of the second three-way fitting 183. Specifically, one of the two sections of the third oil supply tube 151 is located between the output end 68 of the three-way oil supply member 64 and the first end of the second three-way fitting 183. Another of the two sections of the third oil supply tube 151 is located between the inlet 137A of the oil supply control valve 137 and the second end of the second three-way fitting 183. Thus, the two sections of the third oil supply tube 151 intercommunicate with each other due to the second three-way fitting 183 (see FIG. 2). The outlet 137B of the oil supply control valve 137 is coupled to and intercommunicates with a vaporization tube 157 that is helical. In this embodiment, an inner end of the vaporization tube 157 is coupled to and intercommunicates with a first end of the first three-way fitting 155.

A fourth oil supply tube 152 is disposed between and intercommunicates with the outlet 137B of the oil supply control valve 137 and a second end of the first three-way fitting 155. Thus, the outlet 137B of the oil supply control valve 137 is coupled to and intercommunicates with the vaporization tube 157. The vaporization tube 157 includes a smoke output end 158 fixed to a position adjacent to the smoke outlet 14 of the casing 12. The oil supply control valve 137 is switchable between an intercommunication state and a non-intercommunication state. When the oil supply control valve 137 is in the intercommunication state, the oil is permitted to pass through the oil supply control valve 137 into the vaporization tube 157. When the oil supply control valve 137 is in the non-intercommunication state, the oil is not permitted to pass through the oil supply control valve 137 into the vaporization tube 157.

The first return oil control valve 139 includes a guiding end 139A and an oil return end 139B. A first return oil tube 173 intercommunicates with and is disposed between the guiding end 139A of the first return oil control valve 139 and a third end of the first three-way fitting 155. Furthermore, a second return oil tube 175 intercommunicates with and is disposed between the oil return end 139B of the first return oil control valve 139 and the second return oil fitting 54 of the three-way connector 46.

A third return oil tube 177 is disposed between the first return oil fitting 48 of the three-way connector 46 and the return oil fitting 38 of the connecting member 32. An end of the third return oil tube 177 extends through the through-hole 30 of the second cap 28 and is coupled to the return oil fitting 38 of the connecting member 32. The other end of the third return oil tube 177 is coupled to the first return oil fitting 48 of the three-way connector 46. Thus, the channel 40 of the connecting member 32 intercommunicates with the first return oil passageway 58 and the second return oil passageway 59 of the three-way connector 46. After the second cap 28 is tightened, the inner periphery of the through-hole 30 and the return oil fitting 38 tightly clamp the third return oil tube 177, such that the third return oil tube 177 is less likely to disengage from the return oil fitting 38. Thus, the unvaporized oil can flow back into the oil tank 20 when the smoke machine 10 stops. Note that the inner diameter of the third return oil tube 177 is larger than the outer diameter of the first oil supply tube 44, and the first oil supply tube 44 is received in the third return oil tube 177 (see FIG. 2).

A second return oil control valve 181 is disposed between and intercommunicates with the second three-way fitting 183 and the three-way connector 46. The second return oil control valve 181 includes a first end 181A and a second end 181B. A fourth return oil tube 179 is disposed between and intercommunicates with the first end 181A of the second return oil control valve 181 and a third end of the second three-way fitting 183. A fifth return oil tube 193 is disposed between the second end 181B of the second return oil control valve 181 and the second return oil passageway 59 of the three-way connector 46 (see FIGS. 2 and 5). A sixth return oil tube 197 is disposed between the oil return end 131 of the return oil fitting 119 and the second return oil fitting 54 of the three-way connector 46. The second return oil control valve 181 is switchable between an intercommunication state and a non-intercommunication state. When the second return oil control valve 181 is in the intercommunication state, the oil delivered by the two pumps 42 is permitted to flow through the second three-way fitting 183, the fourth return oil tube 179, the fifth return oil tube 193, and the third return oil tube 177 and flows back into the oil tank 20. When the second return oil control valve 181 is in the non-intercommunication state, the oil delivered by the two pumps 42 is not permitted to flow through the second return oil control valve 181.

To provide sufficient time for heating and vaporizing the oil in the vaporization tube 157 into smoke, the vaporization tube 157 coils helically around a heater 159 (comprised of two U-shaped heating coils in this embodiment). The heater 159 and the vaporization tube 157 are overlapped by a heat exchanger 171 which is solid and made of aluminum. The heater 159 can be in the form of an electrical heating coil. The heat energy generated by the heater 159 is transmitted through the heat exchanger 171 to the vaporization tube 157 to heat and vaporize the oil in the vaporization tube 157 into smoke which can be ejected via the smoke output end 158 of the vaporization tube 157.

Figure 4:
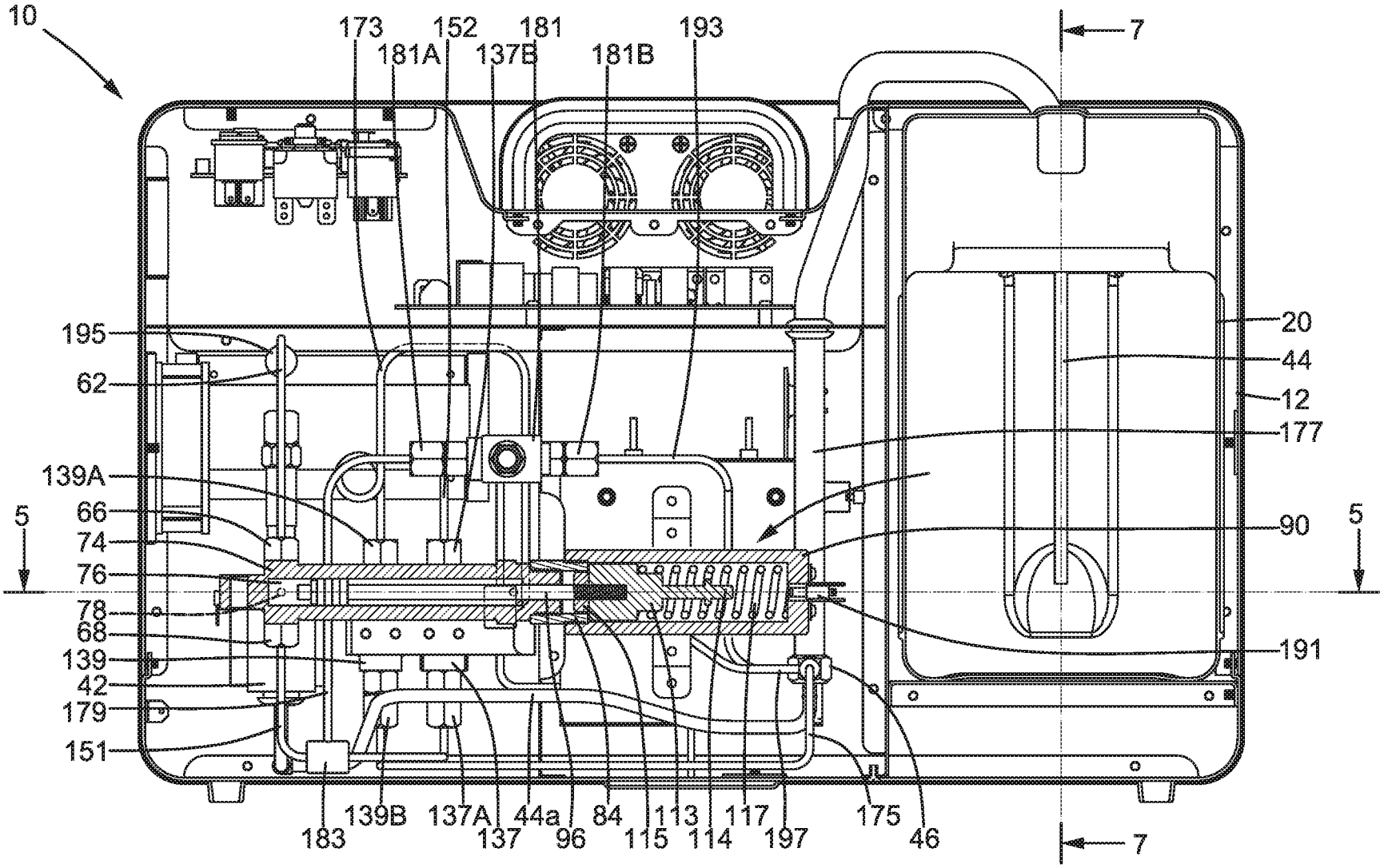
FIG. 4 is a cross sectional view taken along section line 4-4 of FIG. 1.
Figure 5:
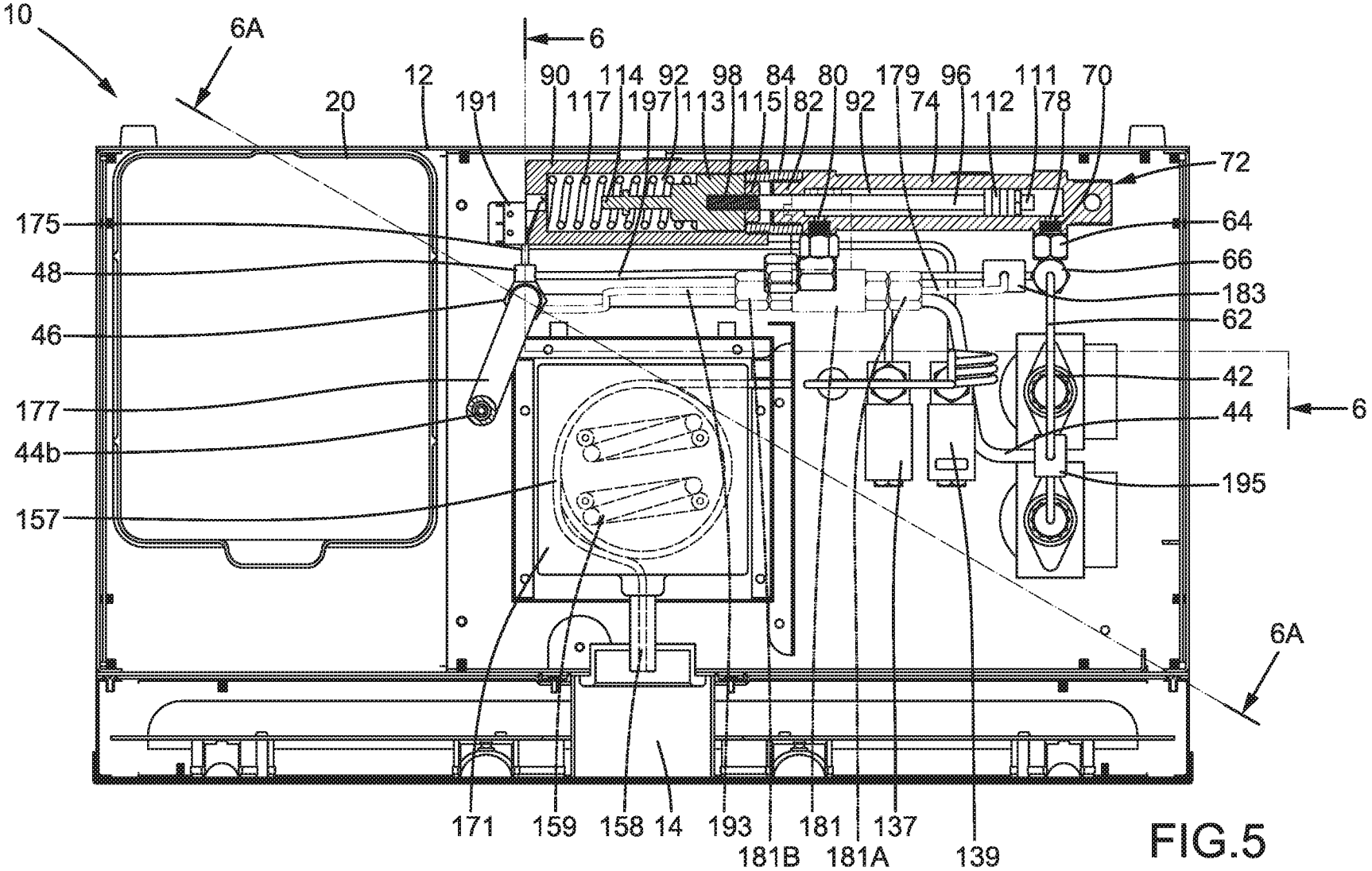
FIG. 5 is a cross sectional view taken along section line 5-5 of FIG. 4.

For the sake of explanation, it will be assumed that the smoke machine 10 is not started, and no oil exists in the storage chamber 76 of the pre-pressurization oil supply device 72. The elastic biasing member 117 biases the movable member 94 to the oil supply position (FIGS. 4 and 5). No oil exists in the vaporization tube 157, and the sensor 191 is not actuated. In this state, the oil supply control valve 137, the first return oil control valve 139, and the second return oil control valve 181 are set to the non-intercommunication state.

While the oil supply control valve 137, the first return oil control valve 139, and the second return oil control valve 181 are set to the non-intercommunication state, oil is injected into and stored in the pre-pressurization oil supply device 72. Specifically, the two pumps 42 operate to suck the oil in the oil tank 20 into the second section 44*b* of the first oil supply tube 44. The oil passes through the oil supply passageway 56 of the three-way connector 46 and the first section 44*a* of the first oil supply tube 44 and enters each of the two pumps 42. The oil in each of the two pumps 42 cannot pass through the second return oil control valve 181 in the non-intercommunication state. Furthermore, since the oil supply control valve 137 is in the non-intercommunication state, the oil supplied from the second oil supply tube 62 can only enter the storage chamber 76 of the pre-pressurization oil supply device 72 via the input end 66 of the three-way oil supply member 64 but cannot enter the fourth oil supply tube 152 via the oil supply control valve 137.

Figure 8:
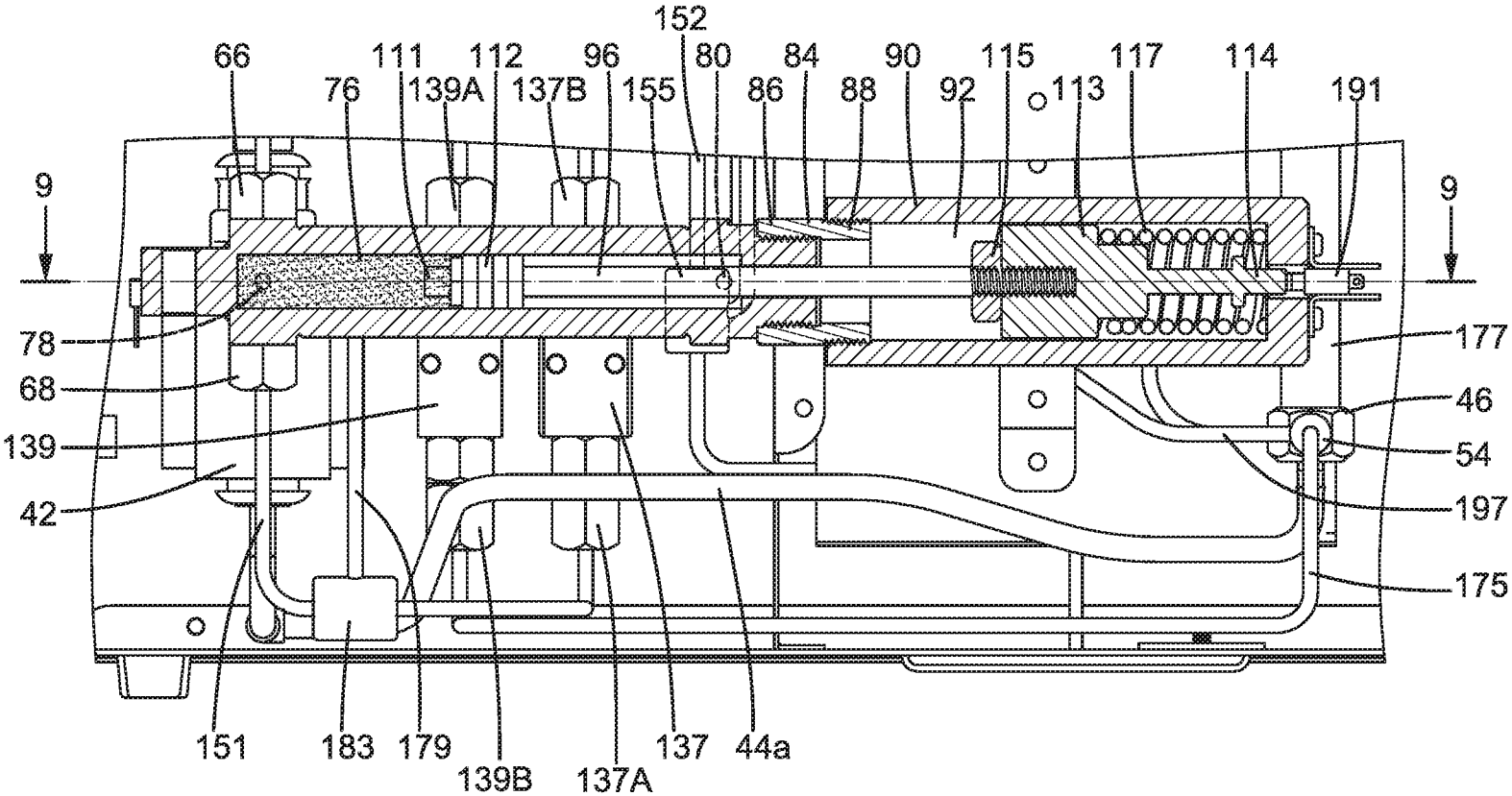
FIG. 8 is a partial, cross sectional view of the smoke generator with a movable member of the pre-pressurization oil supply device moved to an oil storage position.
Figure 9:
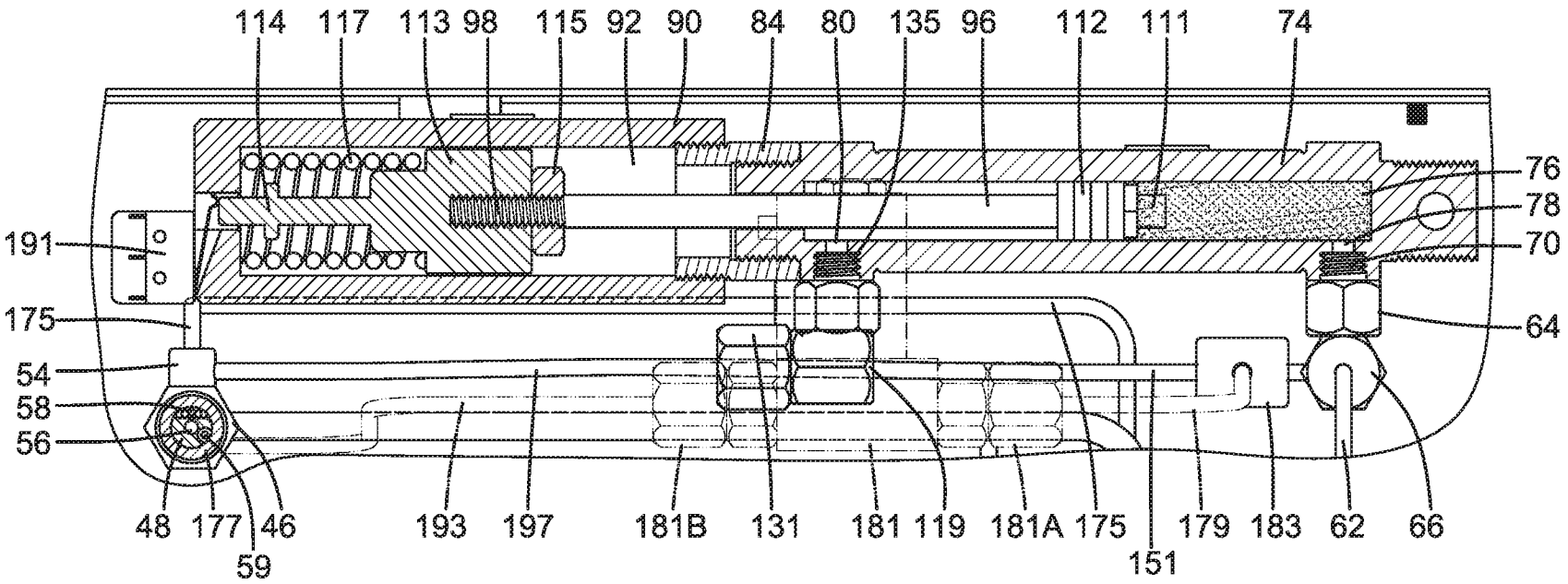
FIG. 9 is a cross sectional view taken along section line 9-9 of FIG. 8.

With reference to FIGS. 8 and 9, the oil that has entered the storage chamber 76 of the pre-pressurization oil supply device 72 squeezes the seal 112 to move the movable member 94 from the oil supply position to the oil storage position while pressing the elastic biasing member 117. The oil is blocked by the seal 112 of the movable member 94 and, thus, cannot flow to the coupling end 135 of the return oil fitting 119. Since the oil supply control valve 137 is in the non-intercommunication state, the movable member 94 of the pre-pressurization oil supply device 72 remains in the oil storage position and in a pre-pressurization state. With reference to FIG. 9, when the movable member 94 is in the oil storage position, the actuating end 114 of the second portion 113 actuates the sensor 191, and the two oil pumps 42 stop. Thus, the smoke machine 10 finishes the pre-pressurized oil storage operation of the pre-pressurization oil supply device 72.

When the smoke machine 10 is about to generate smoke, the oil supply control valve 137 is set to the intercommunication state, and the two oil pumps 42 start to operate. The elastic biasing member 117 of the pre-pressurization oil supply device 72 moves the movable member 94 from the oil storage position to the oil supply position. Thus, the actuating end 114 of the second portion 113 disengages from and does not actuate the sensor 191. The oil in the storage chamber 76 is pressed to move through the connection end 70 and the output end 68 of the three-way oil supply member 64, the third oil supply tube 151, the second three-way fitting 183, the fifth return oil tube 193, and the oil supply control valve 137. The oil outputted by the pre-pressurization oil supply device 72 passes through the fourth oil supply tube 152 and the first three-way fitting 155 and enters the helical vaporization tube 157. During supply of oil by the pre-pressurization oil supply device 72, the internal pressure in the vaporization tube 157 rapidly increases to the maximum value for ejecting smoke. The heater 159 heats the vaporization tube 157 via the heat exchanger 171. The oil in the vaporization tube 157 vaporizes into smoke which is ejected via the smoke outlet 14.

Note that the position of the pre-pressurization oil supply device 72 is more adjacent to the vaporization tube 157 than the two oil pumps 42. Furthermore, an amount of oil with a sufficient pressure has been pre-stored in the cylinder 74, the pre-pressurization oil supply device 72 can supply the oil to the vaporization tube 157 more quickly than the two oil pumps 42. The internal pressure of the vaporization tube 157 more quickly reaches the maximum value for ejecting the smoke. Thus, the smoke machine 10 can be quickly started to eject smoke. After the oil in the storage chamber 76 of the pre-pressurization oil supply device 72 is run out, oil with a sufficient pressure can be supplied to the vaporization tube 157 under operation of the two oil pumps 42. As a result, the smoke machine 10 can continuously eject smoke.

When it is desired to stop ejection of the smoke from the smoke machine 10, the oil supply control valve 137 is set to the non-intercommunication state, such that oil cannot be continuously supplied to the vaporization tube 157. In this state, the two oil pumps 42 still operate to move oil into the storage chamber 76 of the pre-pressurization oil supply device 72.

After the movable member 94 has reached the oil storage position, the actuating end 114 actuates the sensor 191 again, the second return oil control valve 181 is set to the intercommunication state, and the two oil pumps 42 stop at the same time. Since the oil supply control valve 137 has set to the non-intercommunication state, the residual pressure of the two oil pumps 42 (after the first moment of stopping) is still sufficient to push the oil, and the pushed oil cannot enter the second oil supply tube 62 but can enter the fourth return oil tube 179. At this time, the pre-pressurization oil supply device 72 has been pressurized to the maximum pressure, such that the oil cannot enter the storage chamber 76 of the pre-pressurization oil supply device 72. Thus, the oil passes through the second three-way fitting 183, the fourth return oil tube 179, the second return oil control valve 181, the three-way connector 46, and the third return oil tube 177 and flows back into the oil tank 20, reducing the internal pressure of the two oil pumps 42 when not in operation.

When the oil supply control valve 137 is set to the non-intercommunication state for stopping ejection of smoke from the smoke machine 10, the first return oil control valve 139 is also set to the intercommunication state for 1-2 seconds (a maintaining period). Thus, due to operation of the two oil pumps 42 and the high pressure resulting from the high temperature, the unvaporized oil in the vaporization tube 157 can rapidly flow through the first three-way fitting 155 back to the first return oil tube 173 while the first return oil control valve 139 remains in the intercommunication state. Then, the oil flows through the first return oil control valve 139, the second return oil tube 175, the three-way connector 46, and the third return oil tube 177 and flows back into the oil tank 20. Furthermore, the first return oil control valve 139 automatically returns to the non-intercommunication state after the maintaining period (1-2 seconds). The design of backflow of the oil while the smoke ejection is stopped can rapidly reduce the internal pressure of the vaporization tube 157 while the smoke ejection is stopped, rapidly stopping ejection of the smoke from the smoke outlet 14.

Since the outer diameter of the first oil supply tube 44 is smaller than the inner diameter of the third return oil tube 177, the return oil can flow through the gap between the third return oil tube 177 and the first oil supply tube 44. Furthermore, since the inner diameter of the channel 40 of the connecting member 32 is larger than the outer diameter of the first oil supply tube 44, the return oil can flow back into the oil tank 20 through the gap between the channel 40 of the connecting member 32 and the first oil supply tube 44.

When the smoke machine 10 will not be used for a long period of time, the pressure of the pre-pressurization oil supply device 72 must be released, and the oil in the storage chamber 76 must flow back into the oil tank 20. In this embodiment, the second return oil control valve 181 is set to the intercommunication state, such that the elastic biasing member 117 presses against the movable member 94 to squeeze the oil in the storage chamber 76 into the third oil supply tube 151. Then, the oil passes through the second three-way fitting 183 and the fourth return oil tube 179 (the oil cannot pass through the oil supply control valve 137 in the non-intercommunication state). Next, the oil again passes through the second return oil control valve 181, the fifth return oil tube 193, the second return oil passageway 59 of the three-way connector 46, and the third return oil tube 177 and then flows into the oil tank 20. Then, the movable member 94 moves to the oil supply position, and the pressure in the pre-pressurization oil supply device 72 is released.

Furthermore, after long-term use of the pre-pressurization oil supply device 72, the seal 112 could wear and, thus, provides a reduced sealing effect. Thus, the oil leaking through the seal 112 can flow through the second hole 80 and can be guided by the oil return end 131 of the return oil fitting 119 and the sixth return oil tube 197. As a result, the leaked oil is guided into the oil tank 20 via the three-way connector 46 and the third return oil tube 177.

Figure 10:
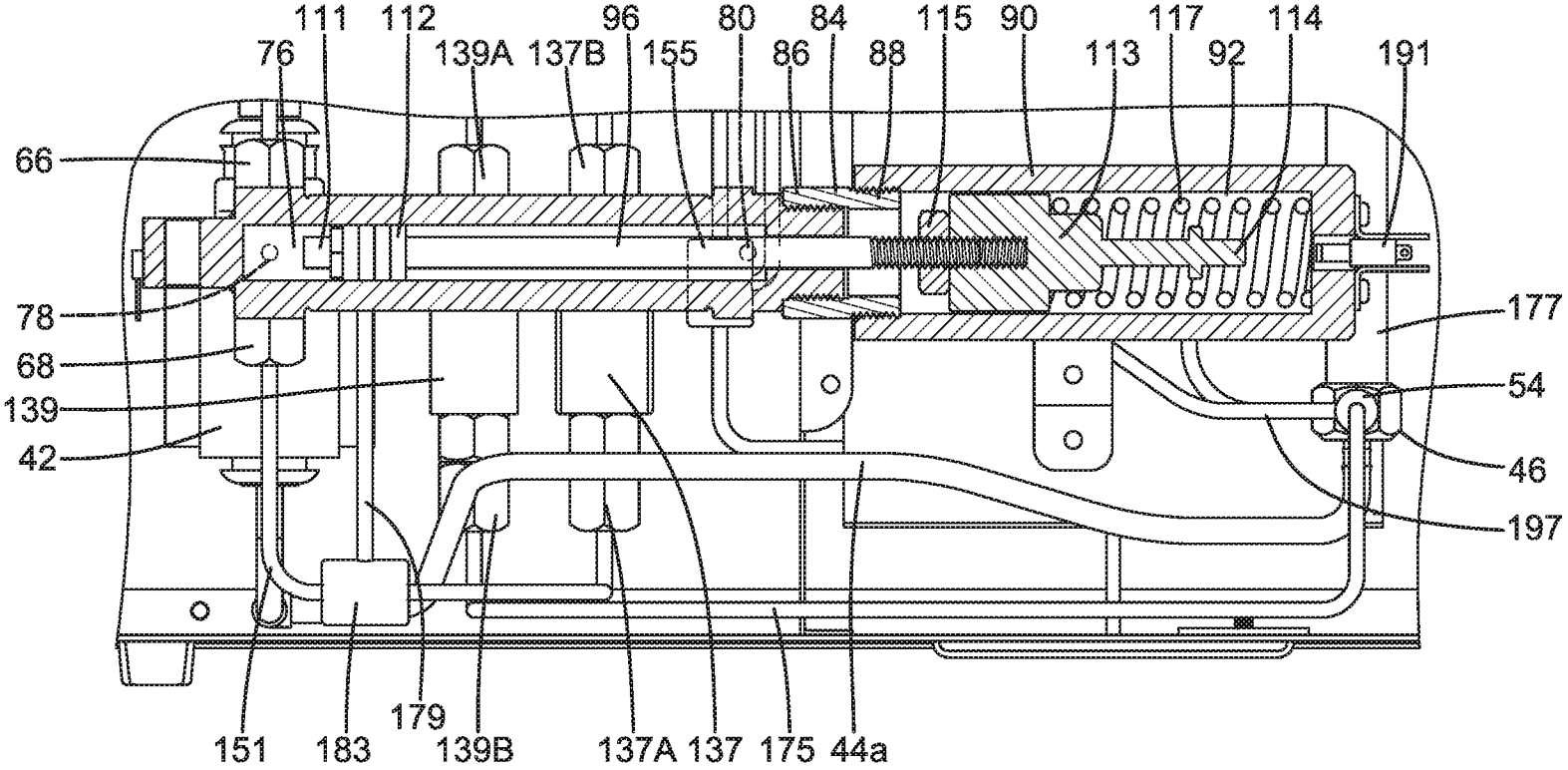
FIG. 10 is a view similar to FIG. 8 with the pre-pressurization oil supply device adjusted to provide a higher biasing force.

The position of the second portion 113 of the pre-pressurization oil supply device 72 can be adjusted relative to the first portion 96 to control the biasing force imparted from the elastic biasing member 117 to the movable member 94. With reference to FIG. 5, the positioning member 115 and the second portion 113 are threadedly coupled to the innermost end of the threading of the assembling end 98, such that the compressed extent of the elastic biasing member 117 is the smallest. With reference to FIG. 10, the second portion 113 is threadedly coupled to the outermost end of the threading of the assembling end 98, and the positioning member 115 abuts against and positions the second portion 113, such that the compressed extent of the elastic biasing member 117 is larger when the movable member 94 is in the oil supply position. Namely, the second portion 113 in FIG. 10 (the oil storage position) can compress the elastic biasing member 117 to an extent more than the second portion 113 in FIG. 5 (the oil supply position) does to the elastic biasing member 117. Thus, the biasing force provided by the elastic biasing member 117 is larger after the movable member 94 moves to the oil storage position.

By providing the pre-pressurization oil supply device 72 between each of the two oil pumps 42 and the vaporization tube 157, since the pre-pressurization oil supply device 72 is more adjacent to the vaporization tube 157 than the two oil pumps 42, the oil can be pre-stored in the pre-pressurization oil supply device 72 through operation of the two oil pumps 42 to make the cylinder 74 has a maximum internal pressure. Thus, sufficient oil can be provided into the vaporization tube 157 by the two oil pumps 42 while the oil pumped from the oil tank 20 has not reached the maximum dynamic pressure. Furthermore, the vaporization tube 157 can rapidly reach the maximum pressure for ejecting smoke in 2-4 seconds when two oil pumps 42 are used. As a result the smoke machine 10 can more rapidly and more uniformly eject smoke, which is advantageous to rapidly generate smoke and to rapidly stop generation of smoke.

In use of the smoke machine 10 to generate smoke, by cooperation of the first return oil control valve 139 with the first return oil tube 173, the second return oil tube 175, and the third return oil tube 177, the oil cannot flow backwards while generating smoke. Furthermore, when the smoke machine 10 stops generating smoke, the oil can return to the oil tank 20 without leaking. Furthermore, the oil can flow back to quickly reduce the internal pressure of the vaporization tube 157, and ejection of smoke from the smoke machine 10 can be stopped rapidly.

By controlling the first return oil control valve 139 and the second return oil control valve 181 to cooperate with the fourth return oil tube 179 and the fifth return oil tube 193, when the smoke machine 10 will not be used for a long period of time, the pressures of the pre-pressurization oil supply device 72 and the two oil pumps 42 can be released by guiding the oil back into the oil tank 20, avoiding excessive pressures of the pre-pressurization oil supply device 72 and the two oil pumps 42 while the smoke machine 10 stops.

Now that the basic teachings of the present invention have been explained, many extensions and variations will be obvious to one having ordinary skill in the art. For example, the smoke machine 10 can include only one oil pump 42 and does not have to include the third return oil tube 177 and the three-way connector 46, and in this condition, the second return oil tube 175, the fifth return oil tube 193, and the sixth return oil tube 197 directly extend to the oil tank 20, permitting the return oil to flow back into the oil tank 20.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A smoke generator comprising:

an oil tank configured to receive an oil;

an oil pump communicating with the oil tank and configured to pump the oil out of the oil tank;

a vaporization tube intercommunicating with the oil pump and configured to receive the oil from the oil pump;

a pre-pressurization oil supply device connected to and disposed between the vaporization tube and the oil pump, wherein when the oil pump operates, a portion of the oil moves into the pre-pressurization oil supply device and causes an increase in an internal pressure in the pre-pressurization oil supply device, and wherein the pre-pressurization oil supply device is switchable between an oil supply state for supplying the oil and a non-supply state not supplying the oil;

a heater disposed adjacent to the vaporization tube and configured to vaporize the oil in the vaporization tube into smoke, wherein when the pre-pressurization oil supply device is in the non-supply state, the pre-pressurization oil supply device does not intercommunicate with the vaporization tube, the pre-pressurization oil supply device maintains its internal pressure, and the oil in the pre-pressurization oil supply device is not delivered to the vaporization tube, and wherein when the pre-pressurization oil supply device is in the oil supply state, the pre-pressurization oil supply device intercommunicates with the vaporization tube, and the oil in the pre-pressurization oil supply device is rapidly delivered to the vaporization tube.

2. The smoke generator as claimed in claim 1, further comprising an oil supply control valve disposed between and intercommunicating with the pre-pressurization oil supply device and the vaporization tube, wherein the oil supply control valve is configured to switch between an intercommunication state in which the pre-pressurization oil supply device supplies the oil and a non-intercommunication state in which the pre-pressurization oil supply device does not supply the oil.

3. The smoke generator as claimed in claim 2, further comprising:

a first oil supply tube disposed between and intercommunicating with the oil tank and the oil pump;

a three-way oil supply member including an input end, an output end, and a connection end coupled to the pre-pressurization oil supply device;

a second oil supply tube disposed between and intercommunicating with the oil pump and the input end of the three-way oil supply member; and a third oil supply tube disposed between and intercommunicating with the oil supply control valve and the output end of the three-way oil supply member, wherein when the oil pump operates, the oil passes through the second oil supply tube, the three-way oil supply member, the third oil supply tube, and the oil supply control valve and enters the vaporization tube, and wherein when the pre-pressurization oil supply device is in the oil supply state, the oil passes through the three-way oil supply member, the third oil supply tube, and the oil supply control valve and enters the vaporization tube.

4. The smoke generator as claimed in claim 1, further comprising:

a first return oil control valve switchable between an intercommunication state and a non-intercommunication state, wherein the first return oil control valve includes a guiding end and an oil return end;

a first three-way fitting intercommunicating with the vaporization tube;

a first return oil tube connected between the guiding end of the first return oil control valve and the first three-way fitting;

a second return oil tube intercommunicating with and disposed between the oil return end of the first return oil control valve and the oil tank, wherein when the oil supply control valve is in the intercommunication state, the first return oil control valve is set to the non-intercommunication state, and the vaporization tube prevents the oil to flow in a reverse direction, and wherein when the oil supply control valve is in the non-intercommunication state, the first return oil control valve is set to remain in the intercommunication state for a maintaining period of 1-2 seconds, unvaporized oil in the vaporization tube is moved by the internal pressure in the vaporization tube to flow back into the oil tank, and the first return oil control valve returns to the non-intercommunication state after the maintaining period.

5. The smoke generator as claimed in claim 4, further comprising:

a three-way connector including an oil supply passageway, a first return oil passageway, and a second return oil passageway, wherein the first return oil passageway and the second return oil passageway are spaced from the oil supply passageway, wherein the first oil supply tube is connected to the oil supply passageway, wherein the second return oil tube is connected between the first return oil passageway and the oil return end of the first return oil control valve;

a third oil supply tube disposed between and intercommunicating with the output end of the three-way oil supply member and an inlet of the oil supply control valve;

a second three-way fitting coupled to the third oil supply tube;

a second return oil control valve including a first end and a second end, wherein the first return oil tube intercommunicates with and is disposed between the guiding end of the first return oil control valve and the first three-way fitting, wherein the second return oil control valve is switchable between an intercommunication state and a non-intercommunication state;

a third return oil tube disposed between and intercommunicating with the oil tank and the first return oil passageway;

a fourth return oil tube disposed between and intercommunicating with the first end of the second return oil control valve and the second three-way fitting; and a fifth return oil tube disposed between and intercommunicating with the second end of the second return oil control valve and the second return oil passageway of the three-way connector, wherein when the second return oil control valve is in the non-intercommunication state, the oil pumped by the oil pump flows to the second oil supply tube, and wherein when the second return oil control valve is in the intercommunication state, the oil pumped by the oil pump flows through the fourth return oil tube, the second three-way fitting, the second return oil tube, and the third return oil tube and flows into the oil tank.

6. The smoke generator as claimed in claim 5, wherein the pre-pressurization oil supply device further includes:

a cylinder including a storage chamber and intercommunicating with the oil pump, wherein when the oil pump operates, the portion of the oil enters the storage chamber;

a sleeve securely disposed to an end of the cylinder;

a movable member movably mounted to the sleeve, wherein the movable member includes a squeezing end received in the storage chamber of the cylinder; and an elastic biasing member received in the sleeve and biasing the cylinder towards the movable member, wherein when the oil pump moves the storage chamber of the cylinder, the movable member moves towards the sleeve to an oil storage position and compresses the elastic biasing member, and wherein when the pre-pressurization oil supply device is in the oil supply state, the elastic biasing member biases the movable member towards the cylinder to an oil supply position, and the squeezing end moves the oil in the storage chamber of the cylinder into the vaporization tube.

7. The smoke generator as claimed in claim 6, wherein the movable member further includes:

a first portion including the squeezing end and an assembling end spaced from the squeezing end, wherein the first portion further includes a seal disposed on the squeezing end, wherein the seal is received in the storage chamber of the cylinder and separates the storage chamber into two sections;

a second portion securely disposed on the assembling end of the first portion, wherein the second portion includes an actuating end and is received in a space of the sleeve, and wherein the elastic biasing member biases the second portion; and a sensor mounted on the sleeve;

wherein when the movable member is in the oil supply position, the actuating end is spaced from the sensor, and the oil pump is permitted to move the oil into the storage chamber, and wherein when the movable member is in the oil storage position, the actuating end actuates the sensor, the oil pump maintains operation when the oil supply control valve is in the intercommunication state or stops when the oil supply control valve is in the non-intercommunication state.

8. The smoke generator as claimed in claim 6, further comprising:

a three-way oil supply member including an input end, an output end, and a connection end coupled to the pre-pressurization oil supply device, wherein the cylinder further includes a first hole intercommunicating with the storage chamber and a second hole intercommunicating with the storage chamber and spaced from the first hole in a longitudinal direction, wherein the seal is located between the first hole and the second hole in the longitudinal direction, and wherein the connection end of the three-way oil supply member is coupled to and intercommunicates with the first hole;

a return oil fitting including a coupling end and an oil return end, wherein the coupling end of the return oil fitting is coupled to and intercommunicates with the second hole of the cylinder;

a second oil supply tube disposed between and intercommunicating with the oil pump and the input end of the three-way oil supply member;

a third oil supply tube disposed between and intercommunicating with the oil supply control valve and the output end of the three-way oil supply member, wherein when the oil pump operates, the oil passes through the second oil supply tube, the three-way oil supply member, the third oil supply tube, and the oil supply control valve and enters the vaporization tube, and wherein when the pre-pressurization oil supply device is in the oil supply state, the oil passes through the three-way oil supply member, the third oil supply tube, and the oil supply control valve and enters the vaporization tube; and a sixth return oil tube disposed between and intercommunicating with the first return oil passageway of the three-way connector and the oil return end of the oil supply control valve, wherein oil leaked through the seal flows through the second hole, the oil return end of the oil supply control valve, the sixth return oil tube, the first return oil passageway of the three-way connector, and the third return oil tube and flows back into the oil tank.

* * * * *